US008385794B2

(12) United States Patent
Yonemoto

(10) Patent No.: US 8,385,794 B2
(45) Date of Patent: Feb. 26, 2013

(54) BELT DEVICE AND IMAGE FORMING APPARATUS PROVIDED WITH THE SAME

(75) Inventor: Satoru Yonemoto, Osaka (JP)

(73) Assignee: Kyocera Mita Corporation (JP)

( * ) Notice: Subject to any disclaimer, the term of this patent is extended or adjusted under 35 U.S.C. 154(b) by 355 days.

(21) Appl. No.: 12/831,321

(22) Filed: Jul. 7, 2010

(65) Prior Publication Data

US 2011/0013951 A1 Jan. 20, 2011

(30) Foreign Application Priority Data

Jul. 14, 2009 (JP) ..... 2009-165819

(51) Int. Cl.
*G03G 15/01* (2006.01)

(52) U.S. Cl. ..... 399/302

(58) Field of Classification Search ..... 399/302, 399/308, 121; 198/806
See application file for complete search history.

(56) References Cited

U.S. PATENT DOCUMENTS

2006/0289280 A1* 12/2006 Furuya et al. ..... 198/806
2007/0144871 A1* 6/2007 Tao et al. ..... 198/806
2010/0329750 A1* 12/2010 Yonemoto ..... 399/301

FOREIGN PATENT DOCUMENTS

JP 9-169449 6/1997
JP 2005-84209 3/2005

* cited by examiner

*Primary Examiner* — Walter L Lindsay, Jr.
*Assistant Examiner* — Rodney Bonnette
(74) *Attorney, Agent, or Firm* — Gerald E. Hespos; Michael J. Porco; Matthew Hespos

(57) ABSTRACT

A belt device includes an endless belt bearing a toner image having a plurality of different colors superimposed one on another, a plurality of rollers on which the belt is mounted, a meandering correcting member correcting the meandering of the belt in a belt width direction, a sensor detecting the position of an end surface of the belt in a width direction of the belt, an adjusting mechanism adjusting the movement of the meandering correcting member, and a controller controlling the adjusting mechanism based on the position detection of the belt end surface by the sensor. The controller controls the adjusting mechanism so that the belt end surface approaches a specified target position and lies within a specified position range including the specified target position. The specified position range is set based on the magnitude of fluctuation of the position of the belt end surface.

10 Claims, 11 Drawing Sheets

BELT DEVICE AND IMAGE FORMING APPARATUS PROVIDED WITH THE SAME

BACKGROUND OF THE INVENTION

1. Field of the Invention

The present invention relates to a belt device including a transfer belt for bearing, for example, a toner image and an image forming apparatus provided with the same.

2. Description of the Related Art

An image forming apparatus such as a printer, a facsimile machine or a copier includes, as main constituent elements, photosensitive drums on which toner images are to be formed based on image information from the outside, a belt device including a transfer belt to which a toner image is to be transferred from the photosensitive drum, a transfer unit for transferring a toner image on the transfer belt to a recording medium such as a sheet and a fixing unit for fixing a toner image on a sheet to the sheet.

A belt device generally includes a drive roller connected to a specified drive source, a plurality of driven rollers and a transfer belt mounted on these rollers. The transfer belt has a toner image transferred from the photosensitive drum while being driven and rotated as the drive roller is rotated.

In the belt device, the transfer belt may move in a belt width direction to meander or to be shifted toward one side during the rotation. If the transfer belt meanders or is shifted toward one side, the positions of color toner images are displaced from each other upon transferring a plurality of color toner images one over another to the transfer belt, which causes color drift. As a result, it becomes difficult to form a high-quality image.

In order to solve such an inconvenience, the meandering or shift of the belt needs to be corrected. A first prior art and a second prior art are known as such a technology. A belt device of the first prior art first executes a first control for correcting the meandering based on a positional deviation between the running position and targeted running position of a belt to make the positional deviation fall within a specified range and then executes a second control for correcting the meandering of the belt based on a deviation between an average value, calculated by sampling the running position of the belt a plurality of times, and the targeted running position, thereby suppressing color drift.

A belt device of the second prior art changes a control parameter, e.g. changes the detection interval of the belt running position from a short interval to a long interval, to correct the meandering of the belt for suppression of color drift when at least two of a belt meandering amount, a meandering change amount and a meandering speed fall to or below correspondingly set specified values.

However, in order to suppress the color drift, it is necessary to switch the control from the first control to the second control in the belt device of the first prior art and to change the control parameter in the belt device of the second prior art, wherefore the color drift suppressing control is complicated.

SUMMARY OF THE INVENTION

Accordingly, in view of the above situation, it is an object of the present invention to provide a belt device capable of suppressing color drift by a simple control and an image forming apparatus provided with the same.

In order to accomplish the above object, one aspect of the present invention is directed to a belt device including an endless belt bearing a toner image having a plurality of different colors superimposed one on another, a plurality of rollers on which the belt is mounted and including a drive roller connected to a specified drive source and rotating the belt, a meandering correcting member correcting the meandering of the belt in a width direction of the belt, a sensor detecting the position of an end surface of the belt in the belt width direction, an adjusting mechanism adjusting the movement of the meandering correcting member, and a controller controlling the adjusting mechanism based on the position detection of the belt end surface by the sensor. The controller controls the adjusting mechanism so that the belt end surface approaches a specified target position and lies within a specified position range including the specified target position. The specified position range is set based on the magnitude of fluctuation of the position of the belt end surface.

DETAILED DESCRIPTION OF THE PREFERRED EMBODIMENTS

Figure 1:
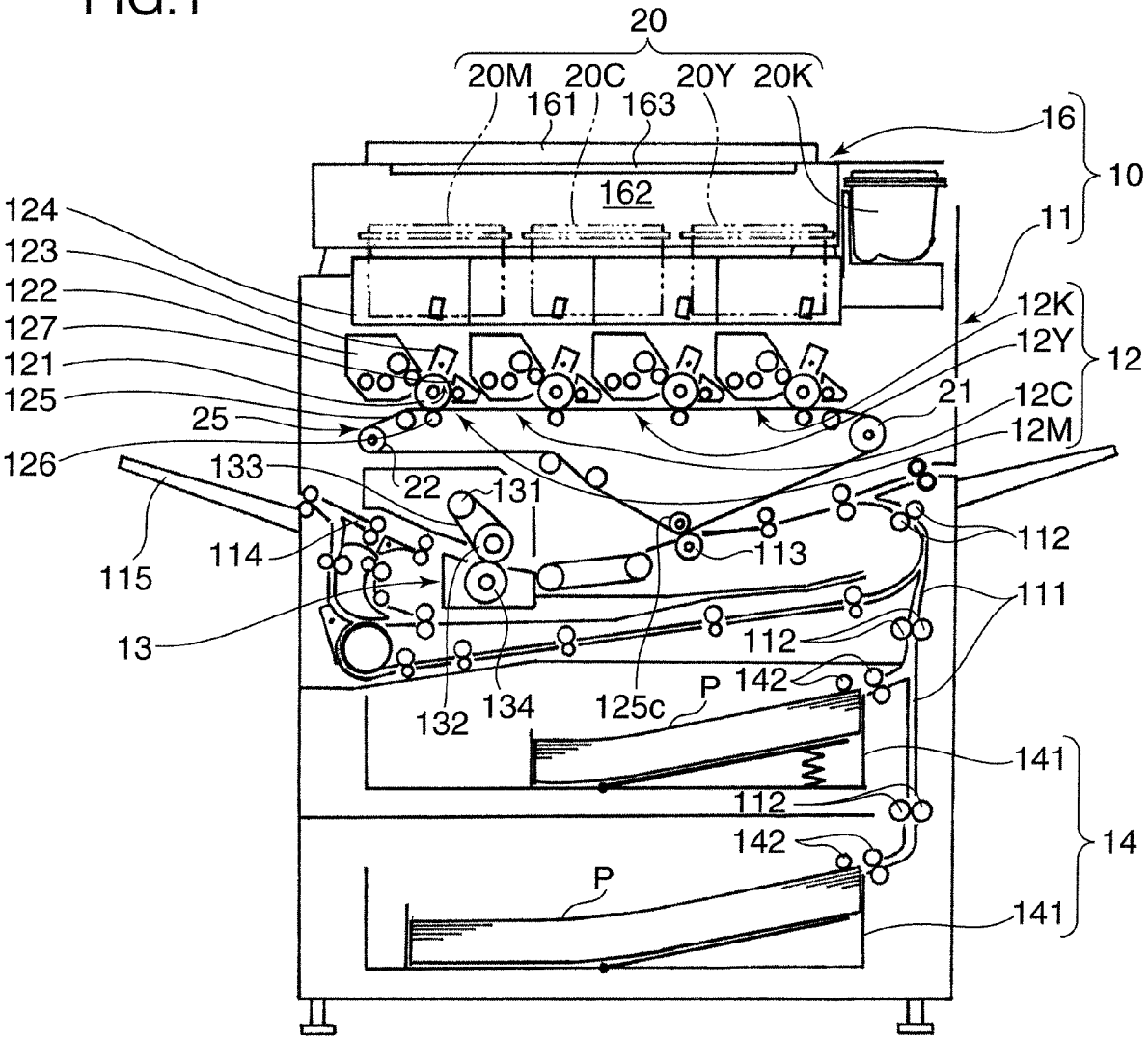
FIG. 1 is a front sectional view showing an exemplary internal construction of an image forming apparatus employing a belt device according to one embodiment.

First of all, an image forming apparatus including a belt device according to one embodiment of the present invention is outlined with reference to FIG. 1. FIG. 1 is a front sectional view showing an exemplary internal construction of the image forming apparatus. The image forming apparatus 10 is used as a copier for color printing and includes, as a basic construction, a box-shaped apparatus main body 11 and an image reader 16 arranged in an upper part of the apparatus main body 11 for reading a document image.

The apparatus main body 11 houses an image forming station 12 for forming an image based on image information of a document read by the image reader 16, a fixing unit 13 for fixing an image formed by the image forming station 12 and then transferred to a sheet P and a sheet storage unit 14 for storing sheets P.

The image reader 16 includes a document presser 161 openably and closably provided on an upper surface of the apparatus main body 11 and an optical unit 162 arranged to face the document presser 161 via a contact glass 163 in the upper part of the apparatus main body 11. The contact glass 163 is so dimensioned as to have a planar shape slightly smaller than the document presser 161 for reading a document surface of a placed document. The document presser 161 is opened and closed by being rotated in forward and reverse directions about a specified shaft at one side of the upper surface of the apparatus main body 11 as one constituent element of the image reader 16.

The optical unit 162 includes unillustrated light source, plural mirrors, lens unit, CCD (charge coupled device). Light from the light source is reflected by a document surface and this reflected light is input to the CCD as document information via these mirrors and lens unit. The document information in the form of an analog quantity input to the CCD is stored in a specified storage device after being converted into a digital signal.

The image forming station 12 is for forming a toner image on a sheet P fed from the sheet storage unit 14 and includes a magenta unit 12M, a cyan unit 12C, a yellow unit 12Y and a black unit 12K successively arranged from an upstream side (left side in the plane of FIG. 1) toward a downstream side. Each of the units 12M, 12C, 12Y and 12K includes a photosensitive drum 121 and a developing device 122. Each photosensitive drum 121 receives the supply of toner from the corresponding developing device 122 while being rotated in a counterclockwise direction in FIG. 1. Toner containers 20 are arranged on the front side (front side of the plane of FIG. 1) and the right side of FIG. 1 in correspondence with the respective developing devices 122, and toners are supplied to the developing devices 122 from the toner containers 20.

The magenta toner container 20M, the cyan toner container 20C, the yellow toner container 20Y and the black toner container 20K for supplying the toners of the respective colors to the corresponding developing devices 122 of the magenta to black units 12M, 12C, 12Y and 12K are detachably mounted in the apparatus main body 11 above the image forming station 12.

A charger 123 is arranged right above each photosensitive drum 121. An exposure device 124 is arranged above the chargers 123 and the developing devices 122. Each photosensitive drum 121 has a circumferential surface thereof uniformly charged by the corresponding charger 123. The charged circumferential surfaces of the photosensitive drums 121 are radiated with laser beams from the exposure device 124 corresponding to the respective colors based on image data input by the image reader 16. In this way, electrostatic latent images are formed on the circumferential surfaces of the photosensitive drums 121. The toners of the respective colors are supplied from the developing devices 122 to the electrostatic latent images, whereby toner images are formed on the circumferential surfaces of the photosensitive drums 121.

A belt device 25 according to this embodiment is arranged below the image forming station 12. The belt device 25 includes a transfer belt 125 disposed below the photosensitive drums 121, a drive roller 21 connected to a drive source (FIG. 3) and adapted to drive and rotate the transfer belt 125, and a driven roller group including a driven roller 22, a secondary-transfer facing roller 125*c*, etc. The transfer belt 125 is an endless belt so mounted on the drive roller 21, the driven roller 22, the secondary-transfer facing roller 125 and other necessary rollers as to be held in contact with the circumferential surfaces of the respective photosensitive drums 121. The belt device 25 also includes primary transfer rollers 126 disposed in correspondence with the respective photosensitive drums 121. The transfer belt 125 is rotated clockwise between the drive roller 21 and the driven roller 22 in synchronization with the respective photosensitive drums 121 while being pressed against the circumferential surfaces of the photosensitive drums 121 by the primary transfer rollers 126. A detailed construction of the belt device 25 is described later.

As the transfer belt 125 is rotated, a magenta toner image formed on the photosensitive drum 121 of the magenta unit 12M is first transferred to the outer surface of the transfer belt 125. Subsequently, a cyan toner image formed on the photosensitive drum 121 of the cyan unit 12C is transferred in a superimposition manner to the transfer position of the magenta toner image on the transfer belt 125. Similarly, a yellow toner image formed by the yellow unit 12Y and a black toner image formed by the black unit 12K are successively transferred in a superimposition manner thereafter. In this way, a full color toner image is formed on the outer surface of the transfer belt 125. The full color toner image formed on the outer surface of the transfer belt 125 is transferred to a sheet P conveyed form the sheet storage unit 14.

A cleaner 127 for cleaning the circumferential surface of the photosensitive drum 121 by removing the residual toner therefrom is disposed to the right of each photosensitive drum 121 in FIG. 1. The circumferential surface of the photosensitive drum 121 cleaned by the cleaner 127 is charged again by the charger 123. The waste toner removed from the circumferential surface of the photosensitive drum 121 by the cleaner 127 is collected into an unillustrated toner collection bottle via a specified path.

The sheet storage unit 14 for storing sheets P is arranged in the bottommost part of the apparatus main body 11. The sheet storage unit 14 includes detachable sheet trays 141 for storing stacks of sheets P. Although the sheet trays 141 are arranged in two levels in the example shown in FIG. 1, they may be arranged in three or more levels or in a single level.

A sheet conveyance path 111 for conveying sheets P from the sheet storage unit 14 is arranged between the image forming station 12 and the sheet storage unit 14. The sheet conveyance path 111 extends from a position to the right of the sheet storage unit 14 to a position below the image forming station 12. Conveyor roller pairs 112 are disposed at specified positions in the sheet conveyance path 111. Further, a secondary transfer roller 113 in contact with the outer surface of the transfer belt 125 is disposed in the sheet conveyance path 111 at a position facing the secondary-transfer facing roller 125*c* of the belt device 25.

Sheets P are dispensed one by one from the sheet trays 141 by the driving of pickup rollers 142. The dispensed sheet P is conveyed toward a nip between the secondary transfer roller 113 and the transfer belt 125 via the sheet conveyance path 111 by the driving of the conveyor roller pairs 112. In the nip, a full color toner image transferred to the outer surface of the transfer belt 125 is transferred to the sheet P.

The fixing unit 13 is for fixing a toner image on a sheet P transferred in the image forming station 12. The fixing unit 13 includes a heating roller 131 internally provided with an electrical heating element such as a halogen heater as a heat source, a fixing roller 132 arranged to face the heating roller 131, a fixing belt 133 mounted between the fixing roller 132 and the heating roller 131, and a pressure roller 134 arranged to face the fixing roller 132 via the fixing belt 133. A sheet P finished with the fixing process and bearing a color image is discharged toward a discharge tray 115 provided on the left wall of the apparatus main body 11 via a discharge conveyance path 114 extending from a position above the fixing unit 13.

Figure 2:
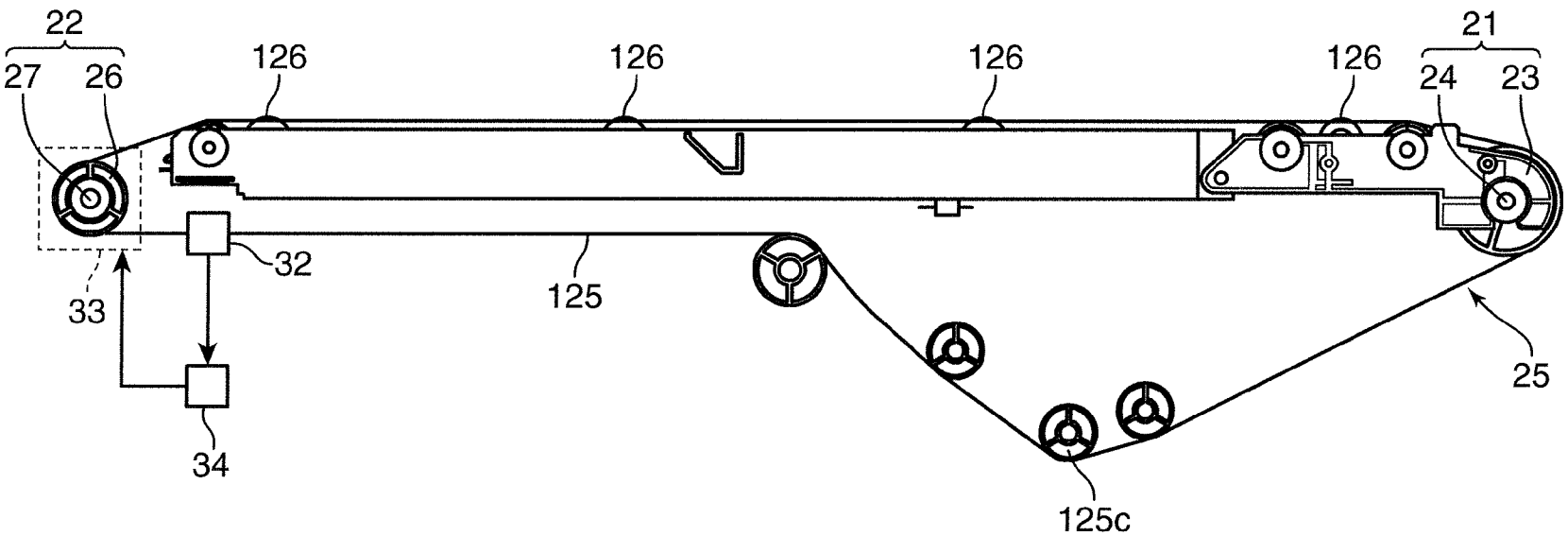
FIG. 2 is an enlarged view of the belt device shown in FIG. 1.

The belt device 25 according to this embodiment is described below. FIG. 2 is an enlarged view of the belt device 25 shown in FIG. 1. As described above, the belt device 25 includes, as basic constituent elements, the drive roller 21 and the driven roller group including the driven roller 22, the primary transfer rollers 126, the secondary-transfer facing roller 125*c* and the like, and the transfer belt 125 mounted on these rollers. The drive roller 21 includes a first roller body 23 and a first rotary shaft 24 coaxial with and integrally rotatably supporting the first roller body 23. The driven roller 22 includes a second roller body 26 and a second rotary shaft 27 coaxial with and integrally rotatably supporting the second roller body 26. The drive roller 21 and the driven roller 22 are arranged to face in a longitudinal direction of the transfer belt 125 with the first and second rotary shafts 24, 27 set in parallel with each other.

Figure 3:
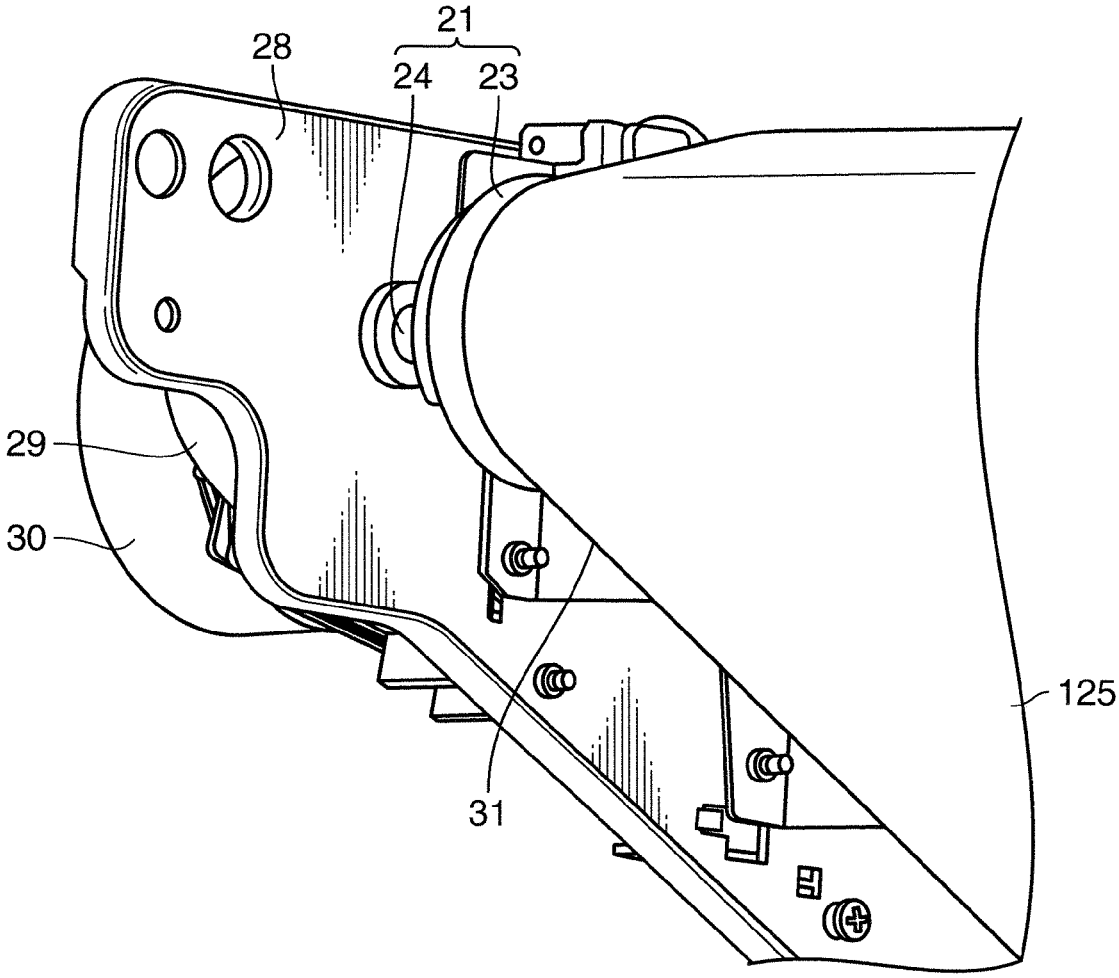
FIG. 3 is a perspective view showing a drive roller of the belt device and its periphery.

The first rotary shaft 24 is rotatably supported on a specified supporting frame 28 as shown in FIG. 3. A gear 29 is so mounted on a part of the first rotary shaft 24 projecting from the supporting frame 28 as to be coaxial with the first rotary shaft 24. The gear 29 is engaged with an output shaft of a drive source, e.g. a motor 30. Thus, when the motor 30 is driven to rotate the output shaft, the gear 29 is rotated. Since the first rotary shaft 24, i.e. the drive roller 21 is rotated as the gear 29 is rotated, the transfer belt 125 is driven and rotated. At this time, the driven roller 22 is driven and rotated as described above.

In the belt device 25 constructed as above, the transfer belt 125 may move in a belt width direction while being rotated, thereby meandering or being shifted toward one side. If the meandering or shift of the transfer belt 125 occurs, the positions of toner images are displaced from each other to cause color drift when the toner images are transferred in a superimposition manner onto the transfer belt 125 from the respective photosensitive drums 121 of the magenta unit 12M, the cyan unit 12C, the yellow unit 12Y and the black unit 12K. In order to ensure a high-quality image by suppressing the color drift, the meandering and shift of the transfer belt 125 need to be quickly corrected.

In this embodiment, in order to correct the meandering and shift of the transfer belt 125, the belt device 25 includes a belt sensor 32 for detecting the position of a belt end surface 31 of the transfer belt 125 in the belt width direction, a meandering correcting member for correcting the meandering of the transfer belt 125 in the belt width direction, an adjusting mechanism 33 for moving the belt end surface 31 in the belt width direction by adjusting the movement of the meandering correcting member, and a controller 34 for controlling the adjusting mechanism 33 based on a detection signal of the belt sensor 32. In this embodiment, the driven roller 22 is employed as an example of the meandering correcting member.

Figure 4:
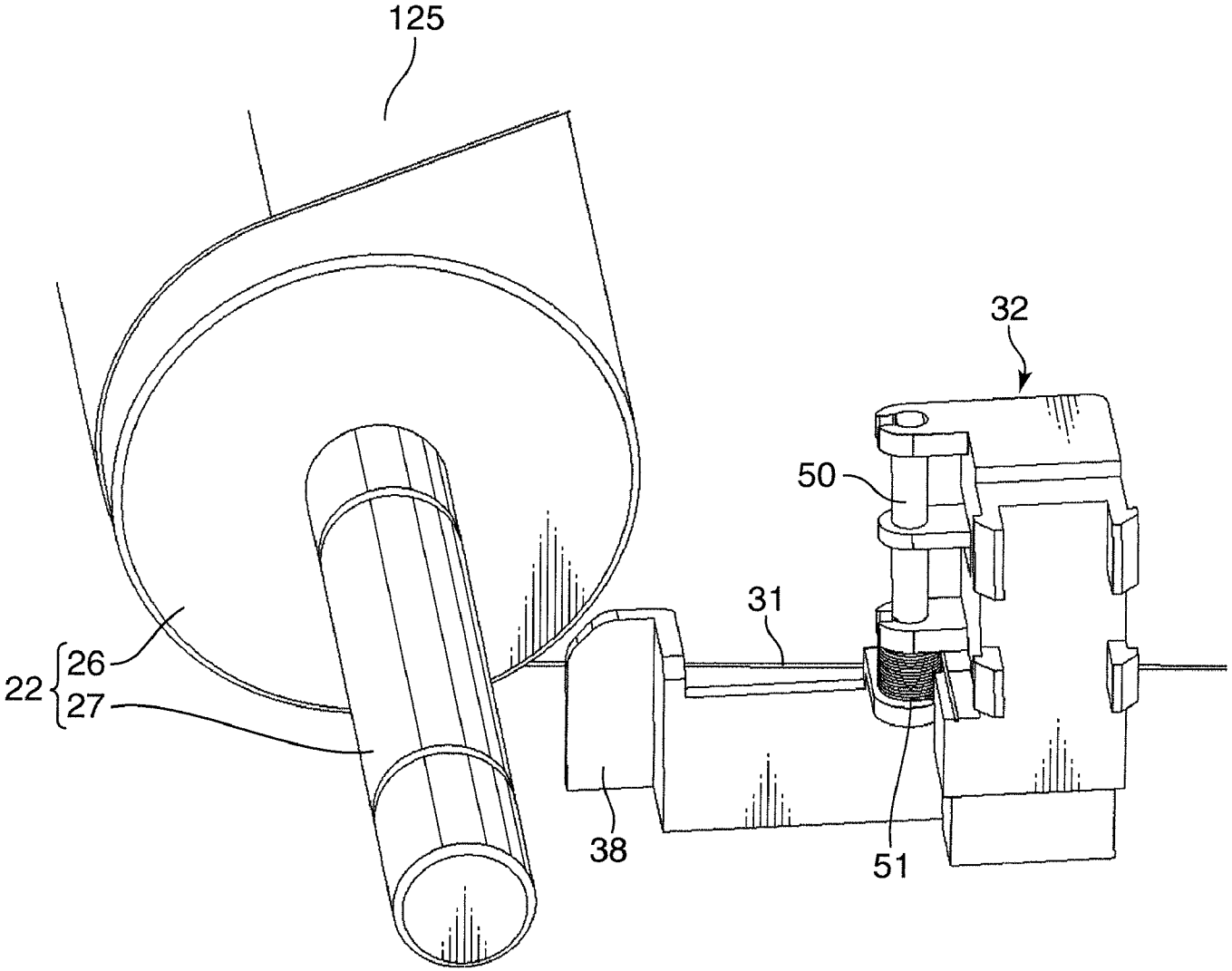
FIG. 4 is a perspective view showing a belt sensor and a driven roller of the belt device.
Figure 5:
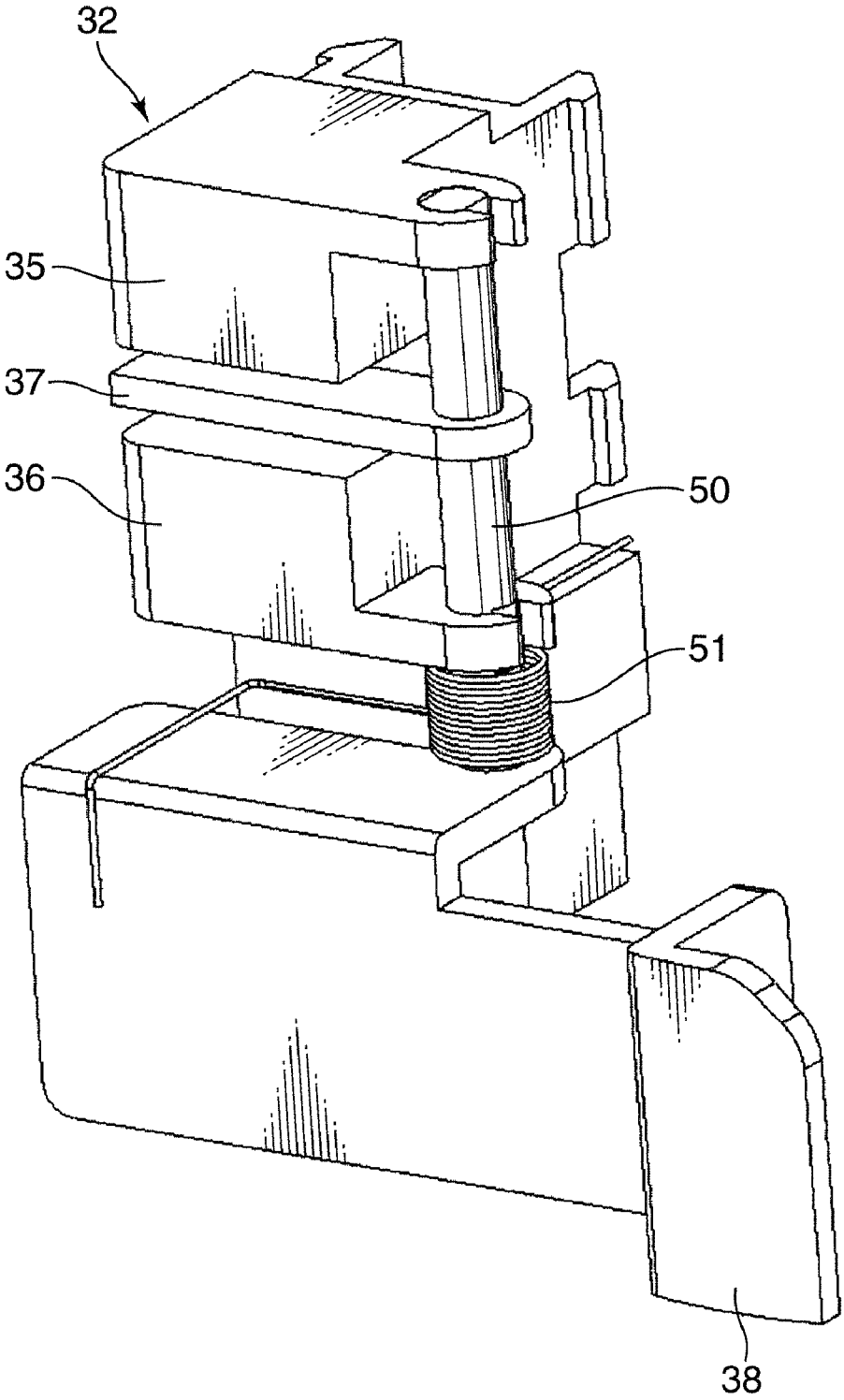
FIG. 5 is a perspective view showing the construction of the belt sensor of the belt device.

As shown in FIG. 2, the belt sensor 32 is arranged near the driven roller 22 on a rotation path of the transfer belt 125. As shown in FIGS. 4 and 5, the belt sensor 32 includes a light emitting part 35 for radiating light in a specified direction (downward in FIGS. 4 and 5), a light receiving part 36 arranged to face the light emitting part 35 for receiving the light, and a light blocking plate 37 arranged movably between the light emitting part 35 and the light receiving part 36.

The belt sensor 32 further includes a contact plate 38 held in contact with the belt end surface 31 of the transfer belt 125 and a coupling rod 50 coupling the contact plate 38 and the light blocking plate 37. The coupling rod 50 is rotatably supported on the light emitting part 35 and the light receiving part 36, wherein the contact plate 38 is supported on one end of the coupling rod 50 via a torsion coil spring 51 and the light block plate 37 is so fixed to a substantially intermediate portion of the coupling rod 50 as to be located between the light emitting part 35 and the light receiving part 36.

If the transfer belt 125 meanders in the belt width direction, the contact plate 38 held in contact with the belt end surface 31 moves in the belt width direction. Accordingly, the light blocking plate 37 coupled to the contact plate 38 moves between the light emitting part 35 and the light receiving part 36. The amount of light received by the light receiving part 36 changes according to a movement amount of the light blocking plate 37, i.e. the amount of light from the light emitting part 35 blocked by the light blocking plate 37. The light receiving part 36 outputs a voltage value (detection signal) corresponding to the received light amount. The controller 34 determines the position of the belt end surface 31 upon receiving the voltage value output from the light receiving part 36.

The belt sensor 32 is so set as to detect the position of the belt end surface 31 at specified detection intervals. The controller 34 corrects the meandering or shift of the transfer belt 125 by controlling the adjusting mechanism 33 based on the voltage value from the belt sensor 31 so that the position of the belt end surface 31 approaches a specified target position in the belt width direction. Prior to the description of the control by the controller 34, the adjusting mechanism 33 is described.

As described above, the adjusting mechanism 33 is a mechanism for moving the belt end surface 31 in the belt width direction by adjusting the position of the driven roller 22. The driven roller 22 is so constructed that the second rotary shaft 27 can be inclined with an unillustrated end portion of the second rotary shaft 27 as a base point to move an other end portion 39 thereof in a specified forward or reverse direction. By inclining the second rotary shaft 27 to move the other end portion 39, the transfer belt 125 mounted on the second roller body 26 of the driven roller 22 can be moved in the longitudinal direction of the driven roller 22. In other words, the belt end surface 31 can be moved in the belt width direction. By finely adjusting the inclination of the second rotary shaft 27, the belt end surface 31 is moved in a first direction or a second direction opposite to the first direction along the belt width direction.

The adjusting mechanism 33 specifically includes a supporting frame 41 with a bearing 40 for rotatably supporting the second rotary shaft 27 of the driven roller 22, a pivot shaft 42 for pivotally supporting the supporting frame 41, a cam 43 for pivoting the supporting frame 41 about the pivot shaft 42, a gear 44 formed coaxially with and integrally to the cam 43 and a drive motor 46 with an output shaft engaged with the gear 44.

Figure 6:
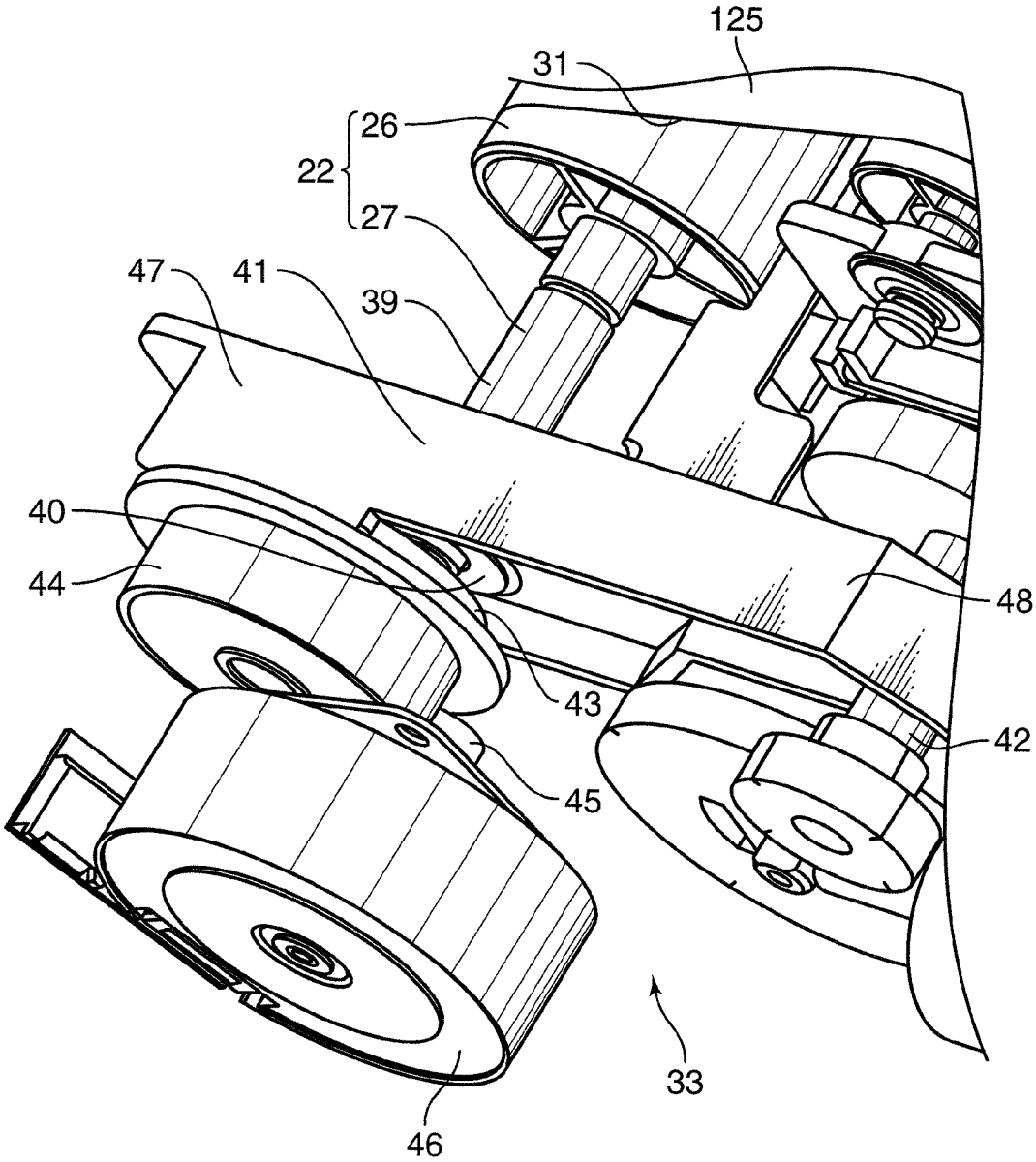
FIG. 6 is a perspective view showing the driven roller of the belt device and its periphery.

The supporting frame 41 is a member extending along the longitudinal direction of the transfer belt 125 at a position lateral to the transfer belt 125 and includes one end portion 47 having the bearing 40 and an other end portion 48 where the pivot shaft 42 is provided. The cam 43 is positioned in contact with a specified contact portion of the one end portion 47 of the supporting frame 41. The supporting frame 41 shown in FIG. 6 is a frame supporting the other end portion 48 of the second rotary shaft 27 and the gear 44 is rotatably supported by an unillustrated supporting shaft.

The adjusting mechanism 33 constructed as above moves the belt end surface 31 of the transfer belt 125 in the belt width direction as follows. In this embodiment, the drive motor 46 is a pulse motor and the controller 34 drives the drive motor 46 by a specified number of drive pulses. A drive force of the drive motor 46 is transmitted to the gear 44 via the output shaft 45, thereby rotating the gear 44. As the gear 44 rotates, the cam 43 formed integrally to the gear 44 pivots the one end portion 47 of the supporting frame 41 about the pivot shaft 42 while being held in contact with the contact portion of the one end portion 47 of the supporting frame 41. In this way, the other end portion 39 of the second rotary shaft 27 of the driven roller 22 supported by the bearing 40 moves in the specified forward or reverse direction with the one end portion of the second rotary shaft 27 as the base point. Since an angle of inclination of the second rotary shaft 27 can be finely adjusted according to the number of drive pulses, the meandering of the belt can be suppressed.

Next, the control of the controller 34 to correct the meandering or shift of the transfer belt 125 based on a voltage value (detection signal) from the belt sensor 32 is specifically described below. In this embodiment, the controller 34 executes the control in view of the shape of the belt end surface 31. When the transfer belt 125 is viewed from above, the belt end surface 31 is often an uneven surface made nonuniform by processing such as cutting at the time of manufacturing. Thus, the position of the belt end surface 31 fluctuates in the belt width direction during the rotation of the transfer belt 125. The range of the fluctuation of the belt end surface position in the belt width direction (that is, the magnitude of the fluctuation of the end surface position in the belt width direction) is determined by a degree of unevenness in the belt width direction.

The fluctuation of the position of the belt end surface 31 means that the transfer belt 125 meanders in the belt width direction if the meandering of the transfer belt 125 is corrected based on the belt end surface 31. Accordingly, this embodiment provides a control method by which the fluctuation (unevenness) of the belt end surface 31 does not affect the meandering correction of the transfer belt 125. A color drift suppressing control by the controller 34 is described below by way of a specific example shown in FIGS. 7 and 8.

Figure 7:
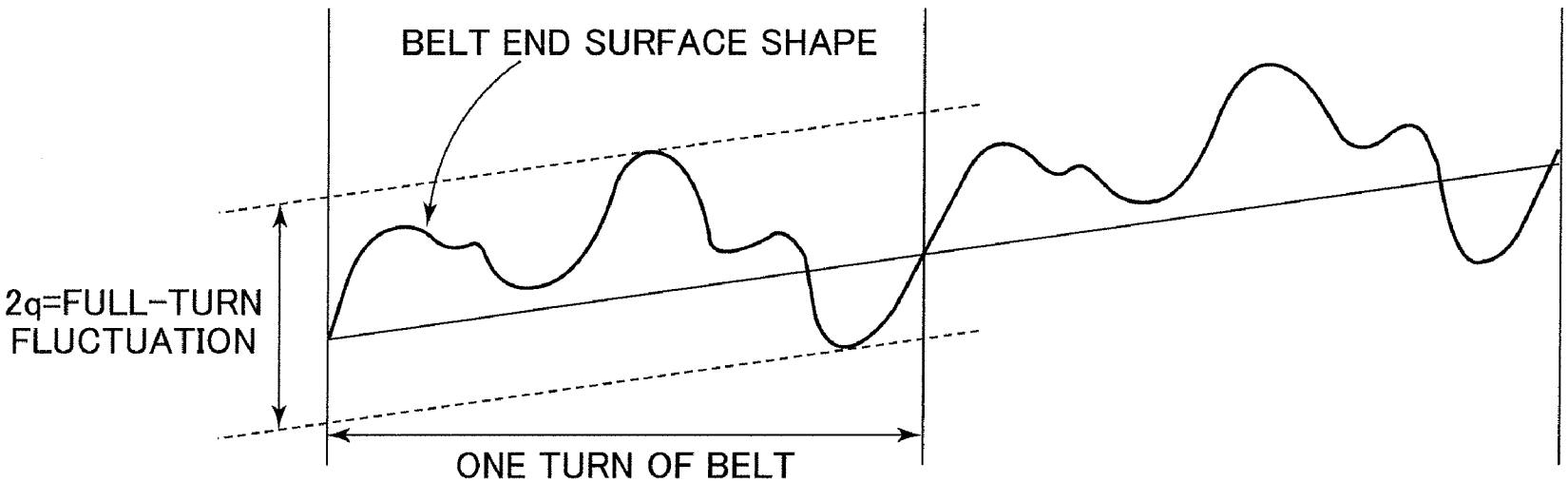
FIG. 7 is a graph showing an exemplary shape of a belt end surface obtained by the belt sensor.

The controller 34 first obtains the shape of the belt end surface 31 (i.e. degree of unevenness) by means of the belt sensor 32 prior to the color drift suppressing control. The belt end surface shape can be obtained by detecting the position of the belt end surface 31 at specified detection intervals while rotating the transfer belt 125 and then linearly connecting these detected positions. FIG. 7 shows an exemplary belt end surface shape obtained by the belt sensor 32. It can be understood from FIG. 7 that the belt end surface position fluctuates. In this embodiment, the magnitude of the fluctuation caused while the transfer belt 125 is making one turn is called a full-turn fluctuation, which is expressed by 2*q*.

After obtaining the belt end surface shape, in order to conduct the color drift suppressing control, the controller 34, based on a voltage value sent at each specified detection interval from the belt sensor 32, adjusts the position of the belt end surface 31 in the belt width direction using the following conditional expressions (1) to (3).

$$b(t)=a(t)-p\times q \text{ when } a(t)>p\times q+r \qquad \text{Conditional Expression (1)}$$

$$b(t)=r \text{ when} -p\times q+r\leqq a(t)p\times q+r \qquad \text{Conditional Expression (2)}$$

$$b(t)=a(t)+p\times q \text{ when } a(t)<-p\times q+r. \qquad \text{Conditional Expression (3)}$$

a(t) represents the position of the belt end surface 31 expressed by a numerical value obtained by converting a sensor output voltage 0 to 5 V into 0 to 1023.

q represents ½ of the full-turn fluctuation 2*q*. 2*q* is a numerical value obtained by converting a sensor output voltage difference 0 to 5 V between the upper limit and the lower limit of the full-turn fluctuation into 0 to 1023.

r represents a specified target position of the belt end surface 31 and, for example, is a numerical value of 512.

p represents an arbitrary constant of, for example, 0.7 to 1.3 and set according to the belt end surface shape.

b(t) represents a function used to approximate the belt end surface 31 to the specified target position.

Figure 8:
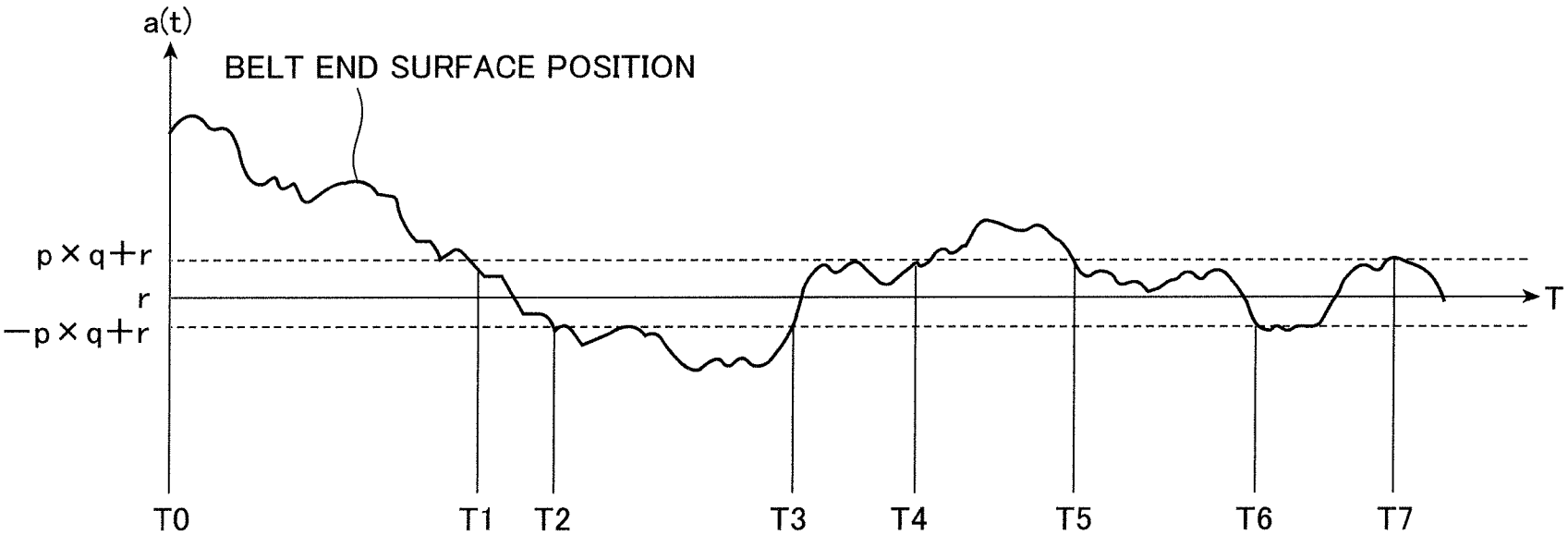
FIG. 8 is a graph showing a control example for adjusting the position of the belt end surface.

FIG. 8 shows a control example for adjusting the position of the belt end surface 31 using the conditional expressions (1) to (3). In FIG. 8, a horizontal axis represents elapsed time and a vertical axis represents the belt end surface position. The controller 34 executes a feedback control so that the belt end surface position lies within a range of +p×q+r to −p×q+r (specified position range) with a specified target position r as a center. The belt meandering can be suppressed by controlling the belt end surface position to lie within the range of +p×q+r to −p×q+r (specified position range) with the specified target position r as the center.

With reference to FIG. 8, time T0 denotes an arbitrary starting time when a new printing operation is started and the detection of the position of the belt end surface 31 by the belt sensor 32 is started. At time T0, the belt end surface 31 is distant from the specified target position r. Since a(t)>+p×q+r at time T0, the controller 34 moves the belt end surface position in accordance with the function b(t) by applying the conditional expression (1).

The belt end surface 31 having moved in accordance with the function b(t) from time T0 lies within the range of +p×q+r to −p×q+r at time T1. At this time, since −p×q+r a(t)≦p×q+r, the controller 34 applies the conditional expression (2), i.e. the adjusting mechanism 33 temporarily stops when the belt end surface 31 comes to lie within the range of +p×q+r to −p×q+r.

Since the transfer belt 125 may meander even if the belt end surface 31 once lies within the range of +p×q+r to −p×q+r, the belt end surface 31 may leave out of the above range. If the belt end surface 31 meanders and deviates from the range of +p×q+r to −p×q+r at time T2, the adjusting mechanism 33 is operated by the controller 34. At this time, since a(t)<−p×q+r, the conditional expression (3) is applied and the belt end surface position is moved in accordance with the function b(t).

The belt end surface 31 having moved in accordance with the function b(t) from time T2 lies within the range of +p×q+r to −p×q+r at time T3. At this time, since −p×q+r a(t)≦+p×q+r, the adjusting mechanism 33 is stopped.

After time T4, the belt end surface 31 deviates from the range of +p×q+r to −p×q+r. At this time, since a(t)>+p×q+r, the controller 34 applies the conditional expression (1) and moves the belt end surface position in accordance with the function b(t). The belt end surface 31 having moved in accordance with the function b(t) from time T4 comes to lie within the range of +p×q+r to −p×q+r again at time T5.

As is clear from FIG. 8, the belt end surface position repeatedly lies within and deviates from the range of +p×q+r to −p×q+r. However, since the controller 34 executes the feedback control, the belt end surface position can be caused to lie within the range of +p×q+r to −p×q+r as shown at times T6 and T7.

In this way, the controller 34 can suppress the belt meandering without being affected by the fluctuation of the belt end surface 31. Thus, it is possible to form a sufficiently high-quality toner image while simplifying the control construction.

Since the controller 34 grasps the shape of the belt end surface in advance by detecting the belt end surface position using the belt sensor 32 while rotating the transfer belt 125, the detection interval of the belt sensor 32 when the belt meandering is corrected can be set according to the shape of the belt end surface.

Figure 9:
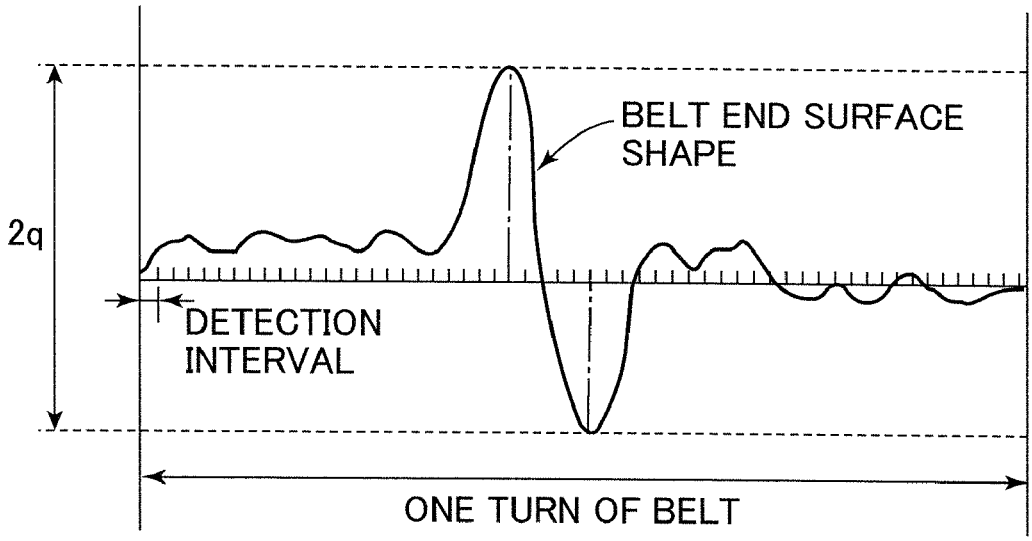
FIG. 9 is a graph explaining the setting of the detection interval of the belt sensor according to the shape of the belt end surface.

Specifically, if the shape of the belt end surface 31 suddenly changes while forming mountain shapes as shown in FIG. 9, the belt meandering resulting from this change can be detected without the belt sensor 32 skipping this change by making the detection interval of the belt sensor 32 smaller than the widths of the mountain shapes. Since the full-turn fluctuation 2*q* resulting from the shape of the belt end surface 31 can be accurately measured in this way, the accuracy of the control using "q" can be improved.

Figure 10:
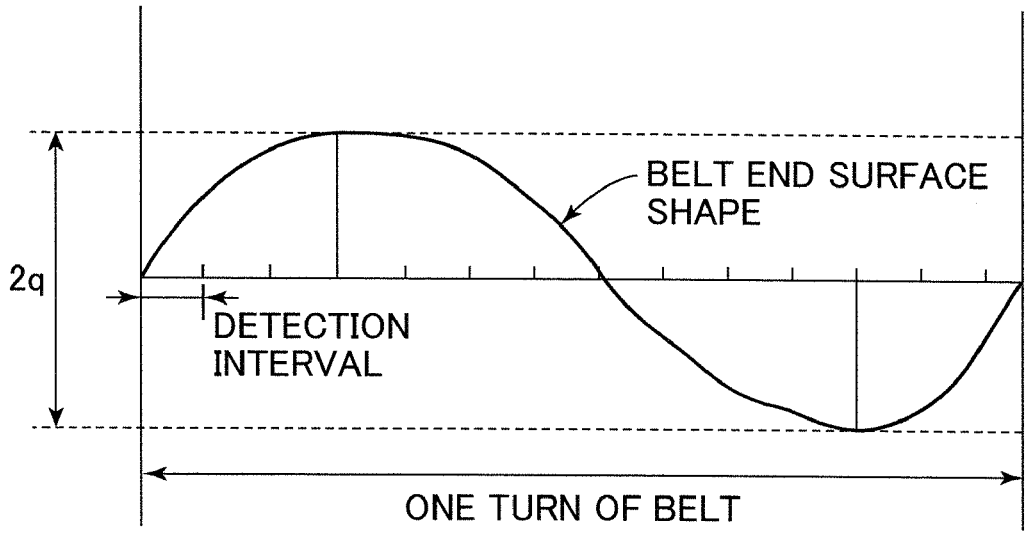
FIG. 10 is a graph explaining the setting of the detection interval of the belt sensor according to the shape of the belt end surface.

Further, as shown in FIG. 10, if the shape of the belt end surface 31 moderately changes, the belt sensor 32 can detect the belt meandering resulting from this change without skipping the change even if the detection interval of the sensor is extended. By extending the detection interval, a load on the controller 34 can be reduced.

Figure 12:
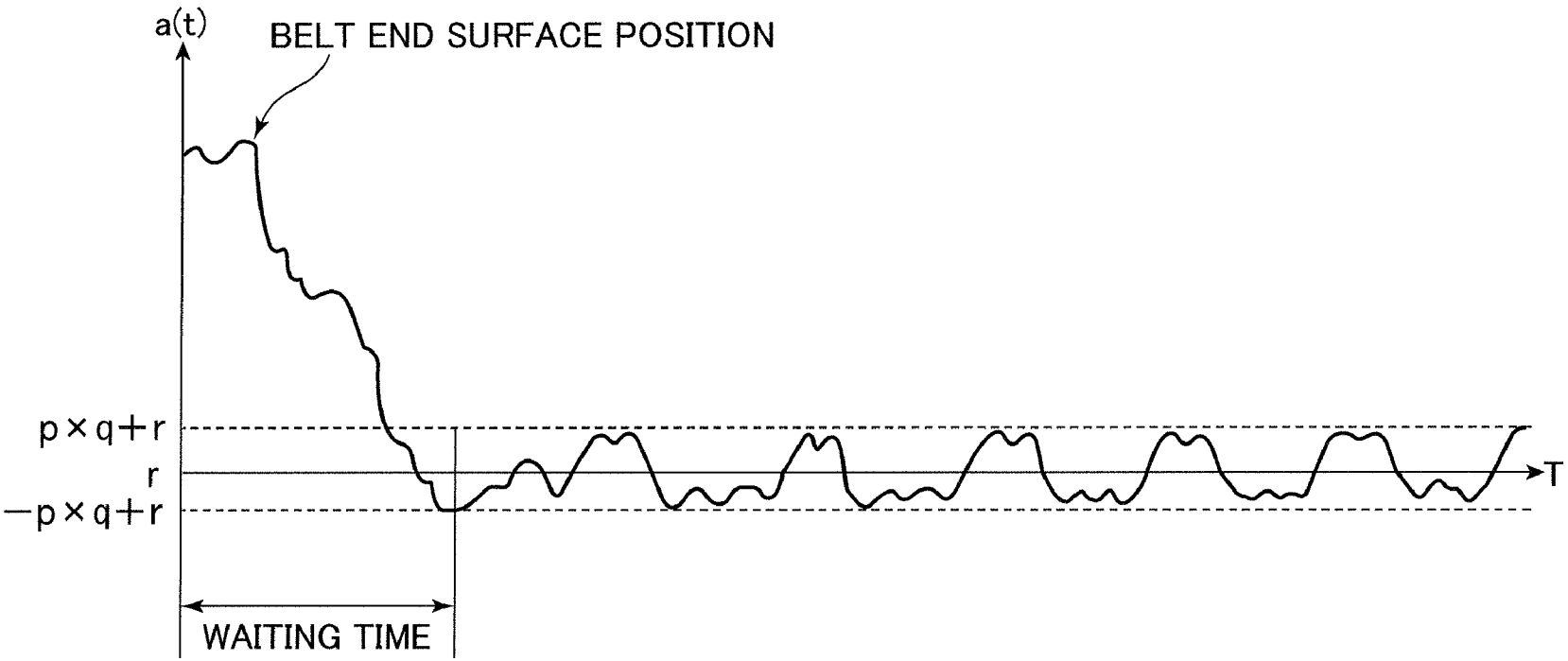
FIG. 12 is a graph showing another control example for adjusting the position of the belt end surface.

In the control example described with reference to FIG. 8, the position of the belt end surface 31 immediately after the start of the driving of the transfer belt 125 is relatively close to the specified target position r. However, the position of the belt end surface 31 immediately after the start of the driving of the transfer belt 125 may be far distant from the specified target position r as shown in FIG. 12. In such a case, if an attempt is made to quickly bring the belt end surface 31 to the specified target position r by the control as shown in FIG. 8, a movement amount of the belt end surface 31 has to be large, wherefore color drift is likely to occur. This color drift can be avoided by causing the transfer belt 125 to bear toner images thereon after the belt end surface 31 is moved from the position immediately after the start of the driving of the transfer belt to the specified target position r, but this results in a waiting time.

Figure 11:
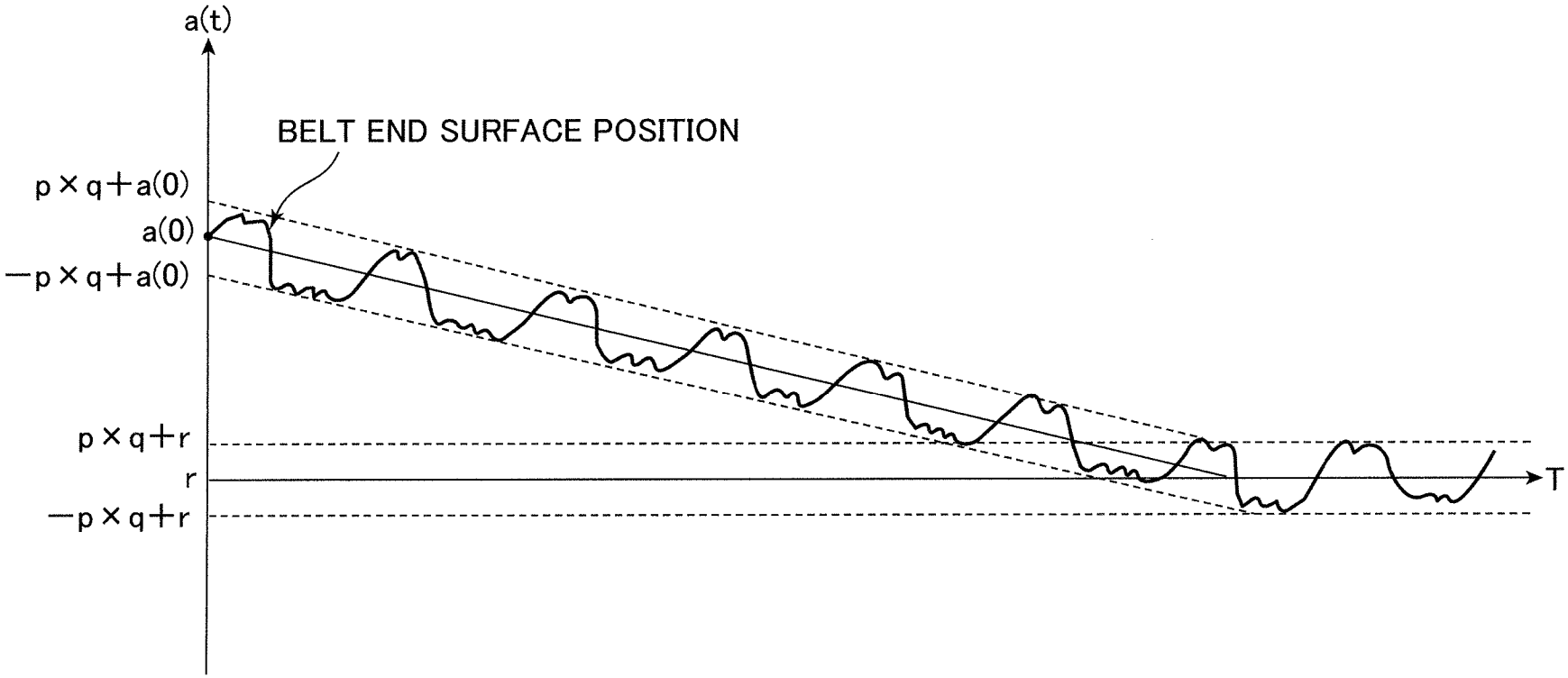
FIG. 11 is a graph showing another control example for adjusting the position of the belt end surface.

Accordingly, in this embodiment, in order to avoid the waiting time, the controller 34 sets the position a(0) of the belt end surface 31, immediately after the start of the driving of the transfer belt 125, as a provisional target position r1 and gradually brings the provisional target position r1 to the specified target position r included the position range (first position range) of +p×q+r to −p×q+r while controlling such that the belt end surface 31 lies within a position range (second position range) of +p×q+a(t) to −p×q+a(t) including the provisional target position r1 as shown in FIG. 11. Since this control can be immediately executed so that the belt end surface 31 lies within the position range of +p×q+a(t) to −p×q+a(t) including the provisional target position r1, there is no waiting time. In addition, the controller 34 can suppress the occurrence of color drift by gradually bringing the provisional target position r1 to the specified target position r As is clear from the control examples described with reference to FIGS. 8 to 11, in the belt device 25 according to this embodiment, the controller 34 can suppress the belt meandering without being affected by the fluctuation of the belt end surface, wherefore it is possible to form a sufficiently high-quality toner image while simplifying the control configuration.

The image forming apparatus according to this embodiment described above, particularly the belt device used in this image forming apparatus may be constructed as follows.

A belt device may include an endless belt bearing a toner image having a plurality of different colors superimposed one on another, a plurality of rollers on which the belt is mounted and including a drive roller connected to a specified drive source and rotating the belt, a meandering correcting member correcting the meandering of the belt in a width direction of the belt, a sensor detecting the position of an end surface of the belt in the belt width direction, an adjusting mechanism adjusting the movement of the meandering correcting member, and a controller controlling the adjusting mechanism based on the position detection of the belt end surface by the sensor. The controller controls the adjusting mechanism so that the belt end surface approaches a specified target position and lies within a specified position range including the specified target position. The specified position range is set based on the magnitude of fluctuation of the position of the belt end surface.

According to the belt device constructed as above, the controller executes such a control that the position of the belt end surface lies within the specified position range including the specified target position, instead of strictly bringing the position of the belt end surface to the specified target position. Accordingly, the control configuration is simplified while color drift is sufficiently suppressed without being affected by the fluctuation of the belt end surface by In the belt device constructed as above, the controller obtains the shape of the belt end surface in advance by detecting the position of the belt end surface using the sensor while rotating the belt, and the detection interval of the belt when the belt meandering is corrected is set according to the shape.

According to this construction, if the shape of the belt end surface suddenly changes, the belt meandering resulting from this change can be detected by shortening the detection interval of the sensor. If the shape of the belt end surface moderately changes, the belt meandering resulting from this change can be detected even if the detection interval of the sensor is extended, wherefore a load on the controller can be reduced.

In the belt device constructed as above, if the position of the belt end surface immediately after the start of the rotation of the belt is assumed to be a provisional target position, the controller gradually brings the provisional target position to the specified target position while controlling the adjusting mechanism so that the belt end surface lies within a specified position range including the provisional target position and set based on the magnitude of the fluctuation.

According to this construction, the position of the belt end surface immediately after the start of the driving of the belt is set as the provisional target position, and the controller immediately executes such a control that the belt end surface lies within a specified position range including the provisional target position and set based on the magnitude of the fluctuation. Thus, there is no waiting time. In addition, the occurrence of the color drift can be suppressed by gradually bringing the provisional target position to the specified target position.

In the belt device constructed as above, the controller determines the magnitude of the fluctuation of the belt end surface position according to a degree of unevenness of the belt end surface in the belt width direction.

Further, in the belt device constructed as above, when a(t) denotes the belt end surface position, 2*q* denotes the magnitude of the fluctuation, r denotes the specified target position and p denotes an arbitrary constant, the specified position range is a range from +p×q+r to −p×q+r, and the controller feedback controls the adjusting mechanism to satisfy a relationship of $-p\times q+r \leqq a(t) \leqq +p\times q+r$.

This application is based on Japanese Patent application serial No. 2009-165819 filed in Japan Patent Office on Jul. 14, 2009, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A belt device, comprising:

an endless belt bearing a toner image having a plurality of different colors superimposed one on another;

a plurality of rollers on which the belt is mounted and including a drive roller connected to a specified drive source and rotating the belt;

a meandering correcting member correcting the meandering of the belt in a width direction of the belt;

a sensor detecting the position of an end surface of the belt in the belt width direction;

an adjusting mechanism adjusting the movement of the meandering correcting member; and a controller controlling the adjusting mechanism based on the position detection of the belt end surface by the sensor, wherein:

the controller controls the adjusting mechanism so that the belt end surface approaches a specified target position and lies within a specified position range including the specified target position, and when a(t) denotes the belt end surface position, 2*q* denotes the magnitude of the fluctuation, r denotes the specified target position and p denotes an arbitrary constant, the specified position range is a range from $+p\times q+r$ to $-p\times q+r$, and the controller feedback controls the adjusting mechanism to satisfy a relationship of $-p\times q+r\leqq a(t)\leqq +p\times q+r$.

2. A belt device according to claim 1, wherein:

the controller obtains the shape of the belt end surface in advance by detecting the position of the belt end surface using the sensor while rotating the belt, and the detection interval of the belt when the belt meandering is corrected is set according to the shape.

3. A belt device according to claim 1, wherein, if the position of the belt end surface immediately after the start of the rotation of the belt is assumed to be a provisional target position, the controller gradually brings the provisional target position to the specified target position while controlling the adjusting mechanism so that the belt end surface lies within a specified position range including the provisional target position and set based on the magnitude of the fluctuation.

4. A belt device according to claim 1, wherein the controller determines the magnitude of the fluctuation of the belt end surface position according to a degree of unevenness of the belt end surface in the belt width direction.

5. A belt device according to claim 1, wherein the controller stops the adjusting mechanism when the relationship of $-p\times q+r\leqq a(t)\leqq +p\times q+r$ is satisfied.

6. An image forming apparatus, comprising:

a plurality of photosensitive drums having surfaces where toner images of respective colors are to be formed, a belt device including an endless belt to which the toner images are to be transferred in a superimposed manner from the photosensitive drums;

a transfer unit transferring the color toner image on the belt to a sheet; and a fixing unit fixing the toner image on the sheet to the sheet, wherein the belt device further includes:

a plurality of rollers on which the belt is mounted and including a drive roller connected to a specified drive source and rotating the belt;

a meandering correcting member correcting the meandering of the belt in a width direction of the belt;

a sensor detecting the position of an end surface of the belt in the belt width direction;

an adjusting mechanism adjusting the movement of the meandering correcting member; and a controller controlling the adjusting mechanism based on the position detection of the belt end surface by the sensor, wherein:

the controller controls the adjusting mechanism so that the belt end surface approaches a specified target position and lies within a specified position range including the specified target position, and when a(t) denotes the belt end surface position, 2*q* denotes the magnitude of the fluctuation, r denotes the specified target position and p denotes an arbitrary constant, the specified position range is a range from $+p\times q+r$ to $-p\times q+r$, and the controller feedback controls the adjusting mechanism to satisfy a relationship of $-p\times q+r\leqq a(t)\leqq +p\times q+r$.

7. An image forming apparatus according to claim 6, wherein:

the controller obtains the shape of the belt end surface in advance by detecting the position of the belt end surface using the sensor while rotating the belt, and the detection interval of the belt when the belt meandering is corrected is set according to the shape.

8. An image forming apparatus according to claim 6, wherein, if the position of the belt end surface immediately after the start of the rotation of the belt is assumed to be a provisional target position, the controller gradually brings the provisional target position to the specified target position while controlling the adjusting mechanism so that the belt end surface lies within a specified position range including the provisional target position and set based on the magnitude of the fluctuation.

9. An image forming apparatus according to claim 6, wherein the controller determines the magnitude of the fluctuation of the belt end surface position according to a degree of unevenness of the belt end surface in the belt width direction.

10. An image forming apparatus according to claim 6, wherein the controller stops the adjusting mechanism when relationship of $-p\times q+r\leqq a(t)\leqq +p\times q+r$ is satisfied.

* * * * *